US008789546B2

(12) United States Patent
Kaufman

(10) Patent No.: US 8,789,546 B2
(45) Date of Patent: Jul. 29, 2014

(54) SHAKABLE CLEANING BAG

(76) Inventor: Harrison Richard Kaufman, Eureka, CA (US)

( * ) Notice: Subject to any disclaimer, the term of this patent is extended or adjusted under 35 U.S.C. 154(b) by 576 days.

(21) Appl. No.: 13/108,974

(22) Filed: May 16, 2011

(65) Prior Publication Data

US 2012/0291817 A1 Nov. 22, 2012

(51) Int. Cl.
*B08B 3/00* (2006.01)

(52) U.S. Cl.
USPC .... 134/137; 134/117; 15/104.001; 206/524.1

(58) Field of Classification Search
None
See application file for complete search history.

(56) References Cited

U.S. PATENT DOCUMENTS 7,497,623 B2 * 3/2009 Thomas et al. ..... 383/63
2006/0110080 A1 * 5/2006 Thomas et al. ..... 383/105

FOREIGN PATENT DOCUMENTS

JP 2000107267 A * 4/2000
JP 2000342890 A * 12/2000

* cited by examiner

*Primary Examiner* — Eric Golightly
(74) *Attorney, Agent, or Firm* — Michael Ries

(57) ABSTRACT

The present invention is a shakable cleaning bag to clean a plurality of objects that includes a base cleaning bag, a cleaning pouch disposed in the base cleaning bag that receives the objects to be cleaned and a perforated cut line disposed on the top portion of the base cleaning bag that is cut when the base cleaning bag is ready to be used. A fastener disposed below the perforated cut line that runs across the base cleaning bag allowing access to the cleaning pouch and an abrasive or non-abrasive alcohol cleaning solution that is contained in the base cleaning bag that has direct contact with the objects that are placed in the base cleaning bag to be cleaned by the alcohol cleaning solution. There is also a two pouch base cleaning bag with a rinsing pouch and rinse solution and a method of use.

15 Claims, 4 Drawing Sheets

SHAKABLE CLEANING BAG

TECHNICAL FIELD & BACKGROUND

It is an object of the present invention to provide a single pouch shakable cleaning bag to clean a variety of objects that is self-contained, clean, reusable and easy to use.

It is an object of the present invention to provide a shakable cleaning bag with a cleaning pouch portion and a rinsing pouch portion to clean a variety of objects that is self-contained, clean, reusable and easy to use.

It is an object of the present invention to provide a method of using a shakable cleaning bag to provide a self-contained, clean and easy to use cleaning method for cleaning dirty smoking utensils, tool components, firearms components and jewelry.

What is really needed is a shakable cleaning bag to provide a single pouch shakable cleaning bag to clean a variety of objects that is self-contained, clean, reusable and easy to use, a shakable cleaning bag with a cleaning pouch portion and a rinsing pouch portion to clean a variety of objects that is self-contained, clean, reusable and easy to use and a method of using a shakable cleaning bag to provide a self-contained, clean and easy to use cleaning method for cleaning dirty smoking utensils, tool components, firearms components and jewelry.

BRIEF DESCRIPTION OF THE DRAWINGS

The present invention will be described by way of exemplary embodiments, but not limitations, illustrated in the accompanying drawing in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1:
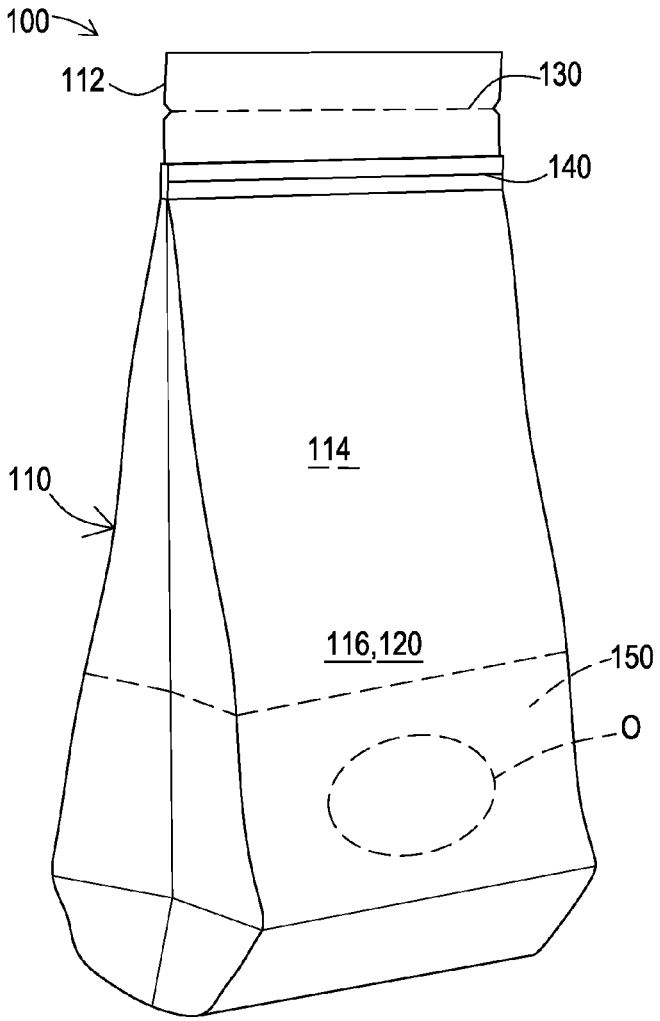
FIG. 1 illustrates a front side environmental perspective view of a shakable cleaning bag, in accordance with one embodiment of the present invention.

FIG. 1 illustrates a front side environmental perspective view of a shakable cleaning bag 100, in accordance with one embodiment of the present invention. The shakable cleaning bag 100 includes a base cleaning bag 110, a cleaning pouch 120, a perforated cut line 130, a tongue and groove fastener 140 and a cleaning solution 150. The shakable cleaning bag 100 provides a single pouch shakable cleaning bag to clean a variety of objects that is self-contained, clean, reusable and easy to use.

The base cleaning bag 110 has a top portion 112, an interior 114 and a front 116. The base cleaning bag 110 is made of heavy duty transparent plastic material, although the base cleaning bag 110 can be made of heavy duty foil material as well as other suitable material. The cleaning pouch 120 is disposed in the interior 114 of the base cleaning bag 110 and receives objects O to be cleaned, degreased and/or disinfected. The objects O include dirty smoking utensils, tool components, firearms components and jewelry and other suitable objects. The perforated cut line 130 is disposed on the top portion 112 of the base cleaning bag 110 and is cut when the base cleaning bag 110 is ready to be used. The perforated cut line 130 runs across the entire front 116 of the base cleaning bag 110. The tongue and groove fastener 140 is disposed below the perforated cut line 130 and can be accessed, opened and resealed as desired once the perforated cut line 130 has been cut. The tongue and groove fastener 140 also runs across the entire front 116 of the base cleaning bag 110, allowing access to the cleaning pouch 120.

The cleaning solution 150 is an abrasive or non-abrasive alcohol solution that is contained in the base cleaning bag 110 and has direct contact with the objects O that are placed in the base cleaning bag 110 to be cleaned. Once the objects O are placed in the base cleaning bag 110 to be cleaned, the shakable cleaning bag 100 is vigorously shaken for 1 minute or other suitable period of time. Once the shaken is stopped, the objects O are rinsed with water and are cleaned and are ready to be reused. The cleaning solution 150 can be reused or recycled as desired and can be any suitable alcohol solution. The cleaning solution 150 also degreases and disinfects any objects O being cleaned.

Figure 2:
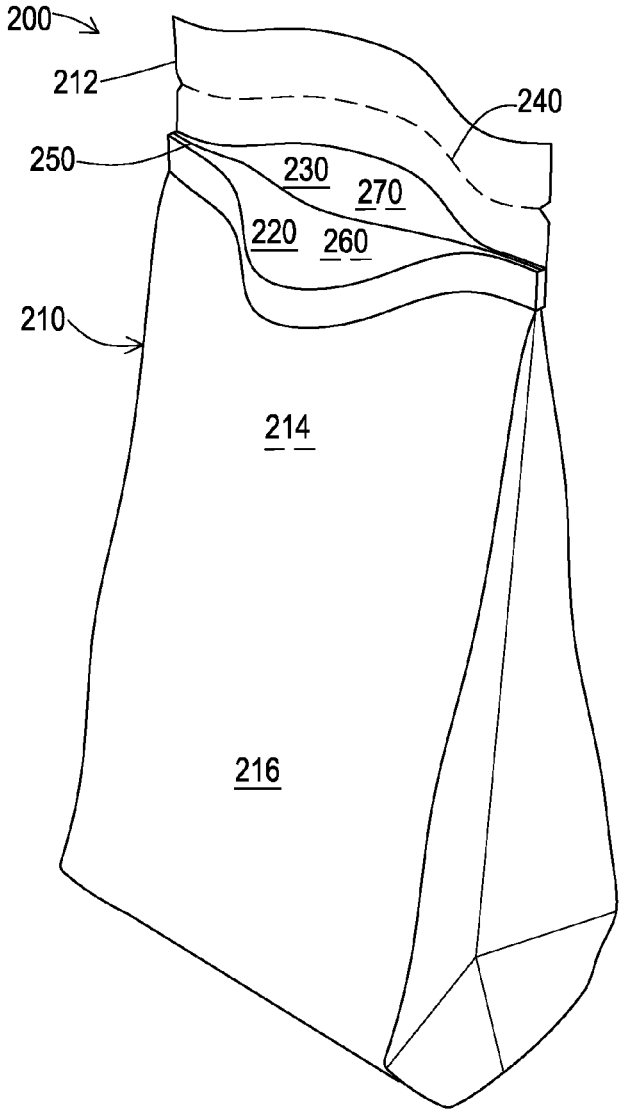
FIG. 2 illustrates a front side environmental perspective view of a shakable cleaning bag, in accordance with one embodiment of the present invention.

FIG. 2 illustrates a front side environmental perspective view of a shakable cleaning bag, 200 in accordance with one embodiment of the present invention. The shakable cleaning bag 200 includes a base cleaning bag 210, a cleaning pouch 220, a rinsing pouch 230, a perforated cut line 240, a tongue and groove fastener 250, a cleaning solution 260 and a rinsing solution 270.

The base cleaning bag 210 has a top portion 212, an interior 214 and a front 216. The base cleaning bag 210 is made of heavy duty transparent plastic material, although the base cleaning bag 210 can be made of heavy duty foil material as well as other suitable material. The cleaning pouch 220 is disposed in the interior 214 of the base cleaning bag 210 and receives objects O to be cleaned, degreased and/or disinfected. The rinsing pouch 230 is disposed in the interior 214 of the base cleaning bag 210 adjacent to the cleaning pouch 220. The perforated cut line 240 is disposed on the top portion 212 of the base cleaning bag 210 and is cut when the base cleaning bag 210 is ready to be used. The perforated cut line 240 runs across the entire front 216 of the base cleaning bag 210. The tongue and groove fastener 250 is disposed below the perforated cut line 240 and can be accessed, opened and resealed as desired once the perforated cut line 240 has been cut. The tongue and groove fastener 250 also runs across the entire front 216 of the base cleaning bag 210, allowing access to the cleaning pouch 220 and the rinsing pouch 230.

The cleaning solution 260 is an abrasive or non-abrasive alcohol solution that is contained in the base cleaning bag 210 and has direct contact with the objects O that are placed in the base cleaning bag 210 to be cleaned. Once the objects O are placed in the base cleaning bag 210 to be cleaned, the shakable cleaning bag 200 is vigorously shaken for 1 minute or other suitable period of time. Once the shaken is stopped, the objects O are rinsed with water and are cleaned and are ready to be reused. The cleaning solution 260 can be reused or recycled as desired and can be any suitable alcohol solution. The cleaning solution 260 also degreases and disinfects any objects O being cleaned. The rinsing solution 270 is water or any other suitable rinsing solution. The objects O are rinsed in the rinsing solution 270 after they have been cleaned in the cleaning solution 260.

Figure 3A:
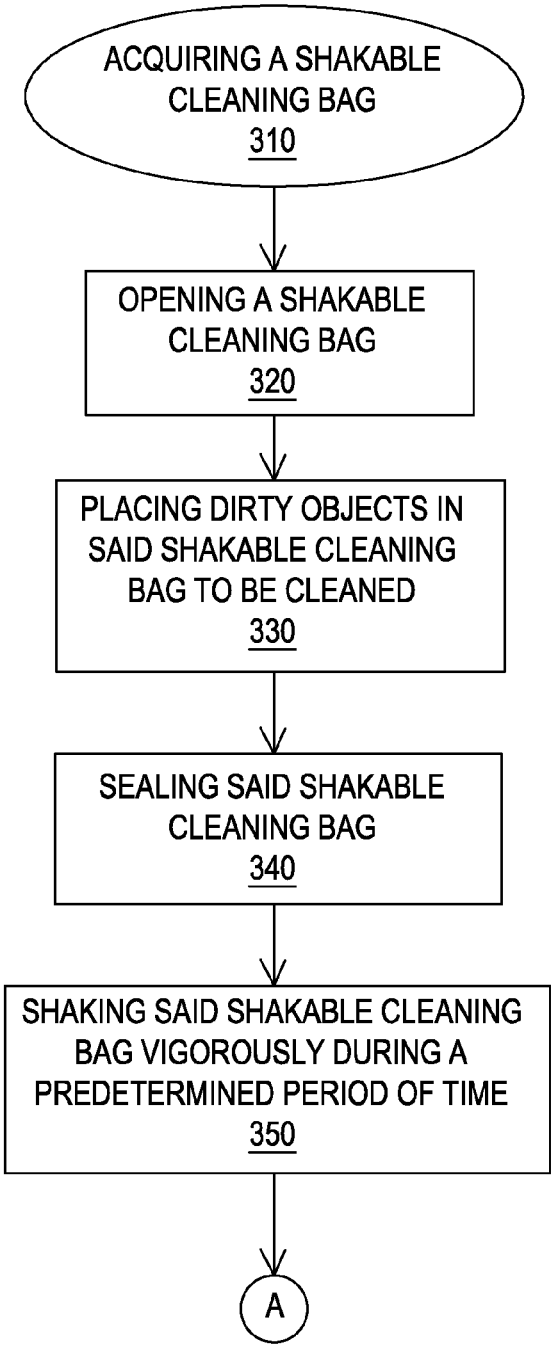
FIG. 3 illustrates a flow chart of a method for using a shakable cleaning bag, in accordance with one embodiment of the present invention.
Figure 3B:
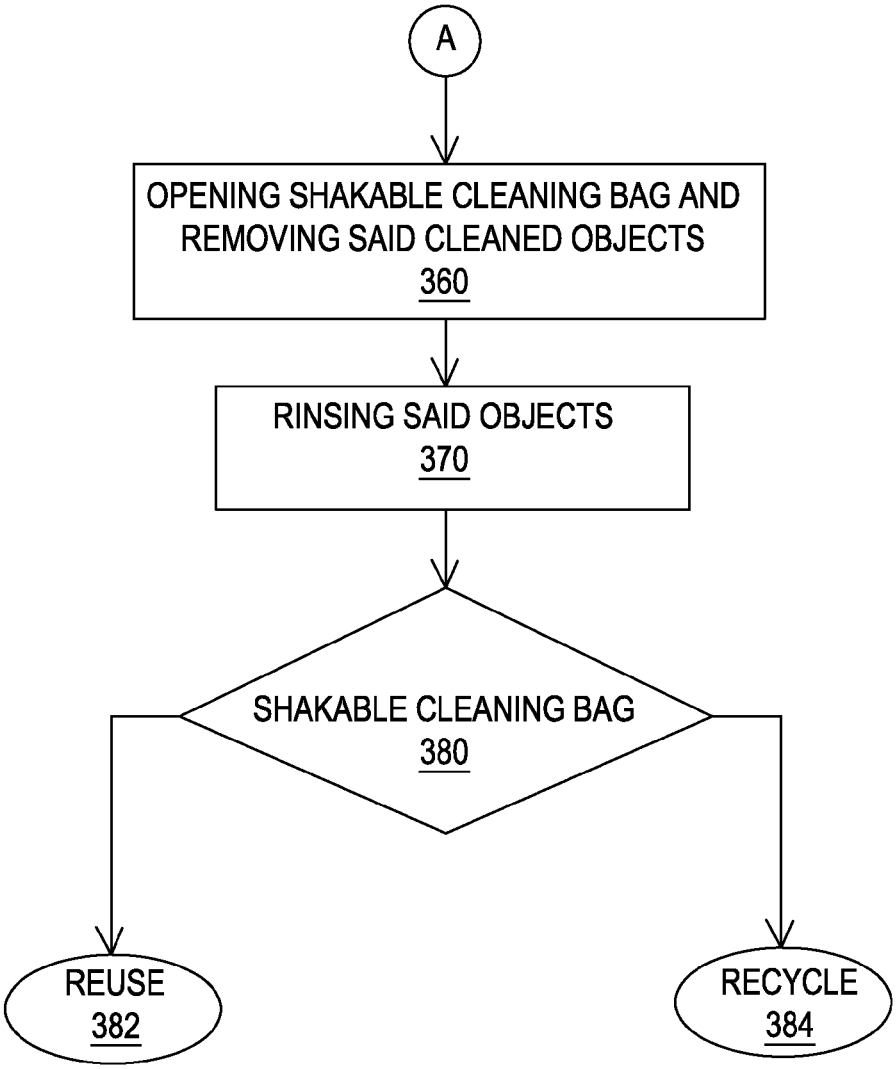

FIG. 3 illustrates a flow chart of a method 300 for using a shakable cleaning bag, in accordance with one embodiment of the present invention. The method 300 includes acquiring a shakable cleaning bag 310, opening a shakable cleaning bag 320, placing dirty objects in said shakable cleaning bag to be cleaned 330, sealing said shakable bag 340, shaking said shakable cleaning bag vigorously during a predetermined period of time 350, opening shakable cleaning bag and removing said cleaned objects 360, rinsing said objects 370 and reusing 382 or discarding 384 said shakable cleaning bag 380.

Acquiring the shakable cleaning bag 310 can be acquired from any suitable shakable cleaning bag source, such as a hardware store. Opening the shakable bag 320 includes cutting a perforated cutting line and opening a tongue and groove fastener. Placing dirty objects in said shakable cleaning bag to be cleaned 330 include objects such as dirty smoking utensils, tool components, firearms components and jewelry and other suitable objects being placed typically by hand into the shakable cleaning bag. Sealing said shakable bag 340 includes closing the tongue and groove fastener. Shaking said shakable cleaning bag vigorously during a predetermined period of time 350 involves grasping the shakable cleaning bag anywhere on the shakable cleaning bag and shaking vigorously for approximately 1 minute or any other suitable predetermined period of time to clean the objects. Opening shakable cleaning bag and removing said cleaned objects 360 involves opening the tongue and groove fastener and removing the cleaned objects. Rinsing said objects 370 can be done within the shakable cleaning bag if there is a rinsing pouch. If there is no rinsing pouch, then the objects can be rinsed outside of the shakable cleaning bag, typically with water or other suitable rinsing liquid.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A shakable cleaning bag to clean a plurality of objects, comprising:

a base cleaning bag with a top portion, an interior and a front;

a cleaning pouch disposed in said interior of the base cleaning bag that receives said objects to be cleaned;

a perforated cut line disposed on said top portion of said base cleaning bag that is cut when said base cleaning bag is ready to be used;

a fastener disposed below said perforated cut line that runs across said front of said base cleaning bag allowing access to the cleaning pouch; and an cleaning solution that is contained in said base cleaning bag that has direct contact with said objects that are placed in said base cleaning bag to be cleaned by said cleaning solution.

2. The cleaning bag according to claim 1, wherein said cleaning bag is made of heavy duty transparent plastic material.

3. The cleaning bag according to claim 1, wherein said cleaning bag is made of heavy duty foil.

4. The cleaning bag according to claim 1, wherein said fastener is a tongue and groove fastener.

5. The cleaning bag according to claim 1, wherein said cleaning solution is an abrasive alcohol solution.

6. The cleaning bag according to claim 1, wherein said objects are selected from the group consisting of dirty smoking utensils, tool components, firearms components or jewelry.

7. The cleaning bag according to claim 1, wherein said objects are degreased and disinfected.

8. A shakable cleaning bag to clean a plurality of objects, comprising:

a base cleaning bag with a top portion, an interior and a front;

a cleaning pouch disposed in said interior of the base cleaning bag that receives said objects to be cleaned;

a rinsing pouch disposed in said interior of said base cleaning bag adjacent to said cleaning pouch;

a perforated cut line disposed on said top portion of said base cleaning bag that is cut when said base cleaning bag is ready to be used;

a fastener disposed below said perforated cut line that runs across said front of said base cleaning bag allowing access to said cleaning pouch and said rinsing pouch;

a cleaning solution that is contained in said base cleaning bag that has direct contact with said objects that are placed in said base cleaning bag to be cleaned by said cleaning solution; and a rinsing solution that is contained in said rinsing pouch that has direct contact with said objects that have been cleaned in said cleaning bag by said cleaning solution to rinse said cleaned objects.

9. The cleaning bag according to claim 8, wherein said cleaning bag is made of heavy duty transparent plastic material.

10. The cleaning bag according to claim 8, wherein said cleaning bag is made of heavy duty foil.

11. The cleaning bag according to claim 8, wherein said fastener is a tongue and groove fastener.

12. The cleaning bag according to claim 8, wherein said cleaning solution is an abrasive alcohol solution.

13. The cleaning bag according to claim 8, wherein said cleaning solution is a non-abrasive alcohol solution.

14. The cleaning bag according to claim 8, wherein said rinsing solution is water.

15. The cleaning bag according to claim 8, wherein said objects are selected from the group consisting of dirty smoking utensils, tool components, firearms components or jewelry.

* * * * *